US005340704A

United States Patent [19]

Ezoe et al.

[11] Patent Number: 5,340,704

[45] Date of Patent: Aug. 23, 1994

[54] METHOD FOR PROCESSING A SILVER HALIDE PHOTOGRAPHIC MATERIAL

[75] Inventors: Toshihide Ezoe; Kazumi Nii; Hisashi Okamura, all of Kanagawa, Japan

[73] Assignee: Fuji Photo Film Co., Ltd., Kanagawa, Japan

[21] Appl. No.: 86,081

[22] Filed: Jul. 6, 1993

[30] Foreign Application Priority Data

Jul. 7, 1992 [JP] Japan ..... 4-179963

[51] Int. Cl.[5] ..... G03C 5/26

[52] U.S. Cl. ..... 430/434; 430/435; 430/264; 430/598; 430/605

[58] Field of Search ..... 430/264, 598, 605, 435, 430/434

[56] References Cited

U.S. PATENT DOCUMENTS

| | | | |
|---|---|---|---|
| 4,818,659 | 4/1989 | Takahashi et al. | 430/264 |
| 4,937,160 | 6/1990 | Ruger | 430/264 |
| 4,987,052 | 1/1991 | Hirano et al. | 430/264 |
| 5,030,546 | 7/1991 | Takamuki et al. | 430/264 |
| 5,037,719 | 8/1991 | Nakamura | 430/264 |
| 5,075,198 | 12/1991 | Katoh | 430/264 |
| 5,124,230 | 6/1992 | Okamura et al. | 430/264 |
| 5,139,921 | 8/1992 | Takagi et al. | 430/264 |
| 5,196,291 | 3/1993 | Okada et al. | 430/264 |
| 5,238,780 | 8/1993 | Takagi et al. | 430/264 |

FOREIGN PATENT DOCUMENTS

| | | |
|---|---|---|
| 0311009 | 4/1989 | European Pat. Off. . |
| 0331096 | 9/1989 | European Pat. Off. . |
| 0356801 | 3/1990 | European Pat. Off. . |
| 3908835 | 9/1989 | Fed. Rep. of Germany . |

*Primary Examiner*—Thomas R. Neville
*Attorney, Agent, or Firm*—Sughrue, Mion, Zinn, Macpeak & Seas

[57] ABSTRACT

Disclosed is a photographic image forming method. A silver halide photographic material is processed with a developing solution having a pH of 9.6 to 11.0. The silver halide photographic material has at least one light-sensitive layer containing a chemically-sensitized silver halide emulsion comprising silver halide grains having a silver chloride content of at least 60 mol %. At least one of said at least one light-sensitive layer and a light-insensitive hydrophilic colloid layer contains a hydrazine compound represented by the formula (1):

$$R^1—NHNH—G—R^2 \quad (1).$$

The variables in the formula are defined in the specification.

18 Claims, No Drawings

METHOD FOR PROCESSING A SILVER HALIDE PHOTOGRAPHIC MATERIAL

FIELD OF THE INVENTION

This invention relates to a silver halide photographic material, and more particularly to an ultra-high contrast silver halide photographic material, for use in photoengraving processes.

BACKGROUND OF THE INVENTION

It is known that hydrazine compounds are added to silver halide photographic emulsions or developing solutions as disclosed in U.S. Pat. No. 3,730,727 (developing solutions containing ascorbic acid and a hydrazine compound in combination), U.S. Pat. No. 3,227,552 (the use of hydrazine compounds as auxiliary developing agents to obtain a direct positive color image), U.S. Pat. No. 3,386,831 (the use of $\beta$-monophenyl hydrazides of aliphatic carboxylic acids as stabilizers for silver halide photographic materials), U.S. Pat. No. 2,419,975, Mees, *The Theory of Photographic Process,* third edition (1966), page 281, etc.

Among them, U.S. Pat. No. 2,419,975 discloses that a high-contrast negative image can be obtained by adding hydrazine compounds.

It is disclosed in U.S. Pat. No. 2,419,975 that very high contrast photographic characteristics of a gamma ($\gamma$) value of higher than 10 can be obtained by adding hydrazine compounds to silver chlorobromide emulsions and carrying out development with developing solutions having a pH of as high as 12.8. However, strongly alkaline developing solutions having a pH of nearly 13 are likely to be oxidized by air. Hence such strongly alkaline developing solutions are unstable and can not be stored or used over a long period of time.

Attempts have been made to develop silver halide photographic materials with developing solutions having a lower pH to obtain a high-contrast image.

JP-A-1-179939 (the term "JP-A" as used herein means an "unexamined published Japanese patent application") and JP-A-1-179940 (which correspond to U.S. Pat. No. 5,139,921) disclose a processing method wherein photographic materials containing nucleating development accelerators having an adsorptive group to silver halide grains and nucleating agents having an adsorptive group to the grains are developed with developing solutions having a pH of not higher than 11.0. However, when the amount of the compounds having an adsorptive group which is added to silver halide emulsions exceeds a critical amount, there are the disadvantages that light sensitivity is deteriorated, development is restrained and the effect of other useful adsorptive additive is deteriorated. Accordingly, the amount of the compounds having an adsorptive group must be limited to a certain amount, with the result that a sufficiently high contrast can not be obtained.

U.S. Pat. Nos. 4,998,604 and 4,994,365 disclose hydrazine compounds having an ethylene oxide repeating unit and hydrazine compounds having a pyridinium group. However, as can be seen in Examples in these U.S. patents high contrast degree is not sufficient, and it is difficult to obtain high contrast and a desired Dmax under practical development processing conditions.

Further, the photographic characteristics of nucleating high-contrast photographic materials greatly fluctuate with change in the pH of the developing solutions. The pH value of the developing solutions is greatly changed by the oxidation of the developing solutions by air and an increase in the concentration thereof caused by the evaporation of water or a lowering in the concentration thereof caused by the absorption of carbon dioxide in air. Accordingly, attempts have been made to reduce the dependence of the photographic performance on the pH of developing solutions.

As mentioned above, there is no conventional photographic material which provides sufficiently high contrast even though it is developed with a developing solution having a pH of not higher than 11 and which is scarcely dependent for its photographic performance on the pH of the developing solution.

SUMMARY OF THE INVENTION

Accordingly, an object of the present invention is to provide a silver halide photographic material which enables photographic characteristics of very high-contrast gradation, that is, of a gamma value higher than 10 to be obtained even with a stable developing solution.

Another object of the present invention is to provide a silver halide photographic material which is less dependent for its photographic performance on the pH of the developing solution.

Still another object of the present invention is to provide a silver halide photographic material with which a high contrast can be obtained by a developing solution having a pH not higher than 11.

These and other objects of the present invention have been achieved by a silver halide photographic material having at least one light-sensitive layer containing a chemical-sensitized silver halide emulsion comprising silver halide having a silver chloride content of at least 60 mol%, wherein at least one of said light-sensitive layer and a light-insensitive hydrophilic colloid layer contains a hydrazine compound represented by the following formula (1):

$$R^1—NHNH—G—R^2 \quad (1)$$

wherein $R^1$ represents a substituted or unsubstituted aliphatic group, alicyclic group, aromatic group or heterocyclic group; G represents —CO—, —$SO_2$—, —SO—, —COCO—, a thiocarbonyl group, an iminomethylene group $$(-\overset{|}{C}=N-R^5,$$

wherein $R^5$ represents a hydrogen atom, a substituted or unsubstituted aliphatic group, alicyclic group or aromatic group) or —P(O)($R^4$)—; $R^2$ represents a substituted alkyl group wherein at least one electron withdrawing group is bonded to a carbon atom of $R^2$ which carbon atom is attached to G; and $R^4$ represents a hydrogen atom, a substituted or unsubstituted aliphatic group, alicyclic group, aromatic group, alkoxy group, aryloxy group or amino group.

DETAILED DESCRIPTION OF THE INVENTION

The compounds of formula (1) are described in more detail below.

In formula (1), the aliphatic or alicyclic group represented by $R^1$ is a straight-chain, branched or cyclic alkyl, alkenyl or alkynyl group, and preferably has from 1 to 30 carbon atoms (in the present invention the number of carbon atoms includes the number of the carbon atoms of the substituent(s)).

The aromatic group represented by $R^1$ may be a monocyclic or bicyclic aryl group, and preferably has from 6 to 30 carbon atoms. Examples thereof include a phenyl group and a naphthyl group.

The heterocyclic ring represented by $R^1$ is a three-membered to ten-membered saturated or unsaturated heterocyclic ring having at least one hetero-atom, as a member of the ring, specifically at least one of N, O and S, and preferably has from 2 to 30 carbon atoms. The ring may be a monocyclic ring or may be a fused ring with an aromatic ring or another hetero-ring. The preferred heterocyclic ring is a five-membered or six-membered aromatic heterocyclic group. Examples thereof include a pyridyl group, an imidazolyl group, a quinolinyl group, a benzimidazolyl group, a pyrimidyl group, a pyrazolyl group, an isoquinolinyl group, a thiazolyl group and a benzthiazolyl group.

Preferably, $R^1$ is an aromatic group, a nitrogen-containing heterocyclic group or a group represented by the following formula (b):

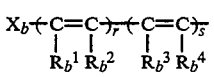

(b)

wherein $X_b$ represents an aromatic group preferably having from 6 to 30 carbon atoms or a nitrogen-containing heterocyclic group preferably those as disclosed in the definition of in R1; $R_b^1$to $R_b^4$each represents a hydrogen atom, a halogen atom (e.g., f, Cl, I, Br) or an alkyl group (preferably having from 1 to 30 carbon atoms); and $X_b$ and $R_b^1$to $R_b^4$ may have one or more substituent groups such as those recited for $R^1$hereinbelow; and r and s each represents 0 or 1.

The nitrogen containing heterocyclic group is preferably a 3- to 10- membered heterocyclic ring, more preferably 5- to 6- membered ring. The group may further contain at least one of N, O and S atoms as a hetero atom. The heterocyclic ring may be fused with an aromatic ring or another heterocyclic ring.

More preferably, $R^1$ is an aromatic group, and an aryl group is particularly preferred.

$R^1$ may be optionally substituted by one or more substituent groups. Examples of the substituent groups include an alkyl group, an aralkyl group, an alkenyl group, an alkynyl group, an alkoxy group, an aryl group, a substituted amino group, an aryloxy group, a sulfamoyl group, a carbamoyl group, an alkylthio group, an arylthio group, a sulfonyl group (in the present invention a sulfonyl moiety includes an alkyl- and aryl-sulfonyl moiety), a sulfinyl group (in the present invention a sulfinyl moiety includes an alkyl- and aryl-sulfinyl moieties), a hydroxyl group, a halogen atom, a cyano group, —$SO_3M$, —COOM (M represents a hydrogen atom, an alkali metal atom such as Li, Na and K, —$NH_4$ and an ammonio group), an alkyl- or aryloxycarbonyl group, an acyl group (in the present invention an acyl moiety includes an aliphatic- and aromatic-acyl moieties), an acyloxy group, a carbonamido group (in the present invention carbonamido group includes an aliphatic- and aromatic-carbonamido group), a sulfonamido group (in the present invention sulfonamido includes an aliphatic- and aromatic-sulfonamido group), a nitro group, an alkylthio group, an arylthio group and a group represented by the following formula (c):

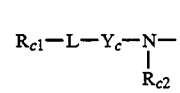

(c)

wherein $Y_c$ represents —CO—, —$SO_2$—, —P(O) ($R_{c3}$)— or —OP(O) ($R_{c3}$)— (wherein $R_{c3}$ is an alkoxy group or an aryloxy group); L represents a single bond, —O—, —S— or —$NR_{c4}$— (wherein $R_{c4}$ is a hydrogen atom, a substituted or unsubstituted aliphatic or alicyclic group or aromatic group) .

$R_{c1}$ and $R_{c2}$ may be the same or different, and each represents a hydrogen atom, a substituted or unsubstituted aliphatic group, alicyclic group, aromatic group or heterocyclic group, or they may be combined together to form a ring.

The number of carbon atoms of the organic groups represented by $R_{c1}$, $R_{c2}$, $R_{c3}$ and $R_{c4}$ is preferably from 1 to 30.

$R^1$ may have one or more substituents represented by formula (c).

In formula (c), the aliphatic or alicyclic group represented by $R_{c1}$ is a straight-chain, branched or cyclic alkyl, alkenyl or alkynyl group.

The aromatic group represented by $R_{c1}$ is a monocyclic, bicyclic aryl group, or a fused ring thereof with a heterocyclic ring such as those defined for $R_{c1}$, Examples thereof include a phenyl group and a naphthyl group.

The heterocyclic group represented by $R_{c1}$ or $R_{c2}$ is a three-membered to ten-membered saturated or unsaturated heterocyclic ring having at least one hetero-atom, as a member of the ring, specifically at least one of N, O and S. The ring may be a monocyclic ring or a fused ring with an aromatic or another heterocyclic ring. Preferably, the heterocyclic ring is a five-membered or six-membered aromatic heterocyclic group. Examples thereof include a pyridyl group, an imidazolyl group, a quinolinyl group, a benzimidazolyl group, a pyrimidyl group, a pyrazolyl group, an isoquinolinyl group, a thiazolyl group and a benzthiazolyl group.

$R_{c1}$ may be substituted by one or more substituent groups. Examples of the substituent groups include an alkyl group, an aralkyl group, an alkenyl group, an alkynyl group, an alkoxy group, an aryl group, a substituted amino group, an acylamino group, a sulfonylamino group, a ureido group, a urethane group (i.e., ROCONH— wherein R represents an alkyl or aryl group), an aryloxy group, a sulfamoyl group, a carbamoyl group, an alkylthio group, an arylthio group, a sulfonyl group, a sulfinyl group, a hydroxy group, a halogen, a cyano group, —COOM and —$SO_3M$ (wherein M represents a hydrogen atom, an alkali metal atom such as Li, Na and K, —$NH_4$ and an ammonio group), an alkyl- or aryloxycarbonyl group, an acyl group, an acyloxy group, a carbonamido group, a sulfonamido group, a nitro group, an alkylthio group an arylthio group, an ammonio group, and a mercapto group.

These groups may be combined together to form a ring, if possible.

These substituents may be further substituted with at least one of these substituents.

In formula (c), the aliphatic or alicyclic group represented by $R_{c2}$ is a straight-chain, branched or cyclic alkyl, alkenyl or alkynyl group.

The aromatic group represented by $R_{c2}$ is a monocyclic or bicyclic aryl group such as phenyl group.

$R_{c2}$ may be substituted. Examples of substituent groups include those already described above in the definition of the substituent groups for $R_{c1}$ in formula (c).

$R_{c1}$ and $R_{c2}$ may be combined together to form a ring.

More preferably, $R_{c2}$ is a hydrogen atom.

In formula (c), $Y_c$ is particularly preferably —CO— or —$SO_2$— and more preferably —$SO_2$—, and L is preferably a single bond or —$NR_{c4}$—.

In formula (c), the aliphatic or alicyclic group represented by $R_{c4}$ is a straight-chain, branched or cyclic alkyl, alkenyl or alkynyl group.

The aromatic group represented by $R_{c4}$ is a monocyclic or bicyclic aryl group such as phenyl group.

$R_{c4}$ may be substituted. Examples of substituent groups include those already described above in the definition of the substituent groups for $R_{c1}$ in formula (c).

More preferably, $R_{c4}$ is a hydrogen atom.

The carbon number of the aliphatic or alicyclic group, the alkoxy group and the amino group (when substituted) represented by $R^4$ or $R^5$ is preferably from 1 to 30, and the carbon number of the aromatic group and aryloxy group represented by $R^4$ or $R^5$ is preferably from 6 to 30.

The aliphatic or alicyclic group, aromatic group, alkoxy group, aryloxy group and amino group may be substituted with at least one of substituents which are cited for $R^1$ hereinabove.

Most preferably, G in formula (1) is —CO—.

$R^2$ in formula (1) is a substituted alkyl group wherein at least one electron withdrawing group, preferably two electron withdrawing groups, particularly preferably three electron withdrawing groups are bonded to carbon atom of $R^2$ which carbon atom is attached to G. The carbon number of the substituted alkyl group is preferably from 1 to 30, more preferably from 1 to 20, and most preferably from 1 to 10.

In $R^2$the electron withdrawing groups substituted to the carbon atom attached to G are preferably those having a $\sigma_p$ value of at least 0.2 or a $\sigma_m$ value of at least 0.3.

The $\sigma_p$ and $\sigma_m$ value are hammett's $\delta$ value, which are disclosed in E. Leffer, E. Greenward, *Rates and Equilibria of Organic Reactions,* John Wiley & Sons (1968), M. S. Newman, ed., R. W. Taft, Jr., *Steric Effect in Organic Chemistry,* John Wiley & Sons (1956), and Japane Chem. Sci ed., *Kagaku Binran (Kisohen),* Vol. II, P. 364, Maruzen (1984).

Examples of the electron withdrawing groups include a halogen atom (such as Cl, F, Br and I), a cyano group, a nitro group, a nitrosopolyhaloalkyl group (examples of halogen atoms include Cl, F, Br and I), a polyhaloaryl group (examples of halogen atoms include Cl, F, Br and I), an alkyl- or arylcarbonyl group, a formyl group, an alkyl- or aryloxycarbonyl group, an alkylcarbonyloxy group, a carbamoyl group, an alkyl- or aryl-sulfinyl group, an alkyl- or aryl-sulfonyl group, an alkyl- or aryl-sulfonyloxy group, a sulfamoyl group, a phosphino group, a phosphine oxide group, a phosphonic ester group, a phosphonic acid amido group, an arylazo group, an amidino group, an ammonio group, a sulfonio group and an electron deficiency group such as a nitrogen-containing heterocyclic group (e.g., pyridyl, pyradinyl, pyridinium, pyridadinyl). Among these groups electron attractive organic groups preferably have from 1 to 29 carbon atoms.

In the present invention, phosphine oxide group, phosphonic ester group, phosphonic acid amido group, ammonio group, and sulfonio group can be represented by the following formulae (d) to (h), respectively:

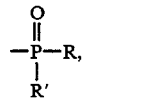
(d)

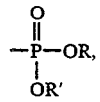
(e)

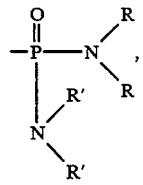
(f)

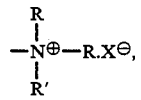
(g-1)

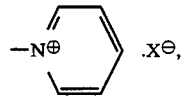
(g-2)

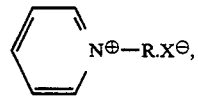
(g-3)

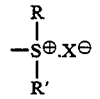
(h)

wherein R and R′ each represents a hydrogen atom, an aliphatic group, an alicyclic group or an aromatic group, and $X^{\ominus}$ represents an anion such as a halide anion (e.g., $Cl^{\ominus}$, $Br^{\ominus}$, $F^{\ominus}$, $I^{\ominus}$) a sulfonate anion or a toluyl sulfonate anion.

The total of the value of $\sigma_p$ or $\sigma_m$ of the electron withdrawing groups which are substituted at the carbon atom of $R^2$which carbon atom bonds to G is not more than 2.0. when the total value exceeds 2.0 the stability of the compound deteriorates.

Particularly preferably, $R^2$ in formula (1) is a trifluoromethyl group.

In formula (1), each of $R^1$ and $R^2$ may have a ballast group or a polymer which is conventionally used in immobile photographic additives such as couplers. The ballast group is a group which has not less than 8 carbon atoms and is relatively inert to photographic characteristics. Examples of the ballast group include an alkyl group, an alkoxy group, a phenyl group, an alkylphenyl group, a phenoxy group and an alkylphenoxy group. Examples of the polymer include those described in JP-A-1-100530.

In formula (1), each of $R^1$ and $R^2$ may have a group which enhances adsorption to the surfaces of silver halide grains. Examples of such an adsorptive group include a thiourea group, a heterocyclic thioamido group, a mercapto heterocyclic group and a triazole group described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

Examples of the compounds which can be used in the present invention include, but are not limited to, the following compounds (in a chemical formula in the present invention an alkyl group having no symbol such as n-, i- and t- represents an n-alkyl group):

Compound 1

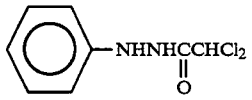

Compound 2

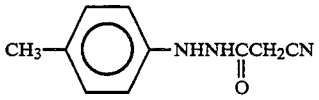

Compound 3

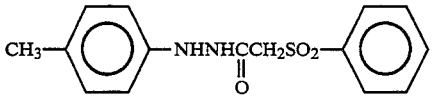

Compound 4

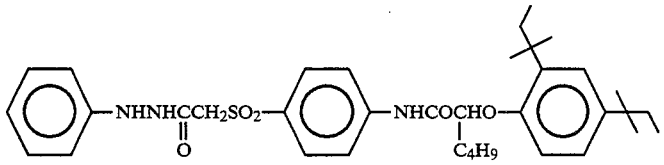

Compound 5

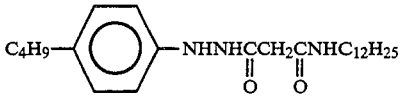

Compound 6

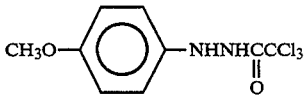

Compound 7

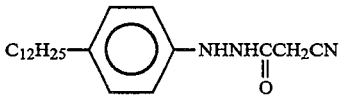

Compound 8

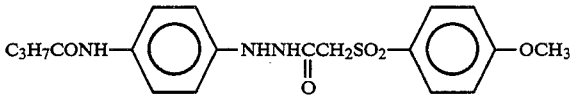

Compound 9

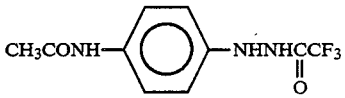

Compound 10

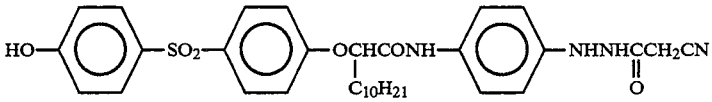

Compound 11

-continued
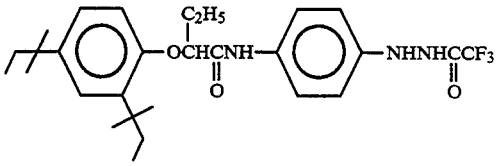
Compound 12
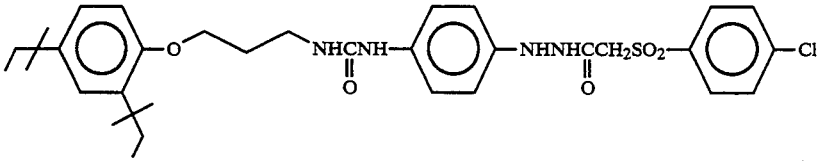
Compoud 13
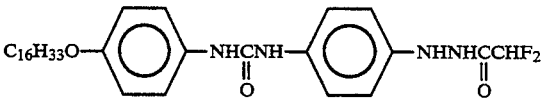
Compound 14
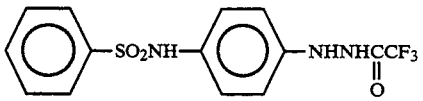
Compound 15
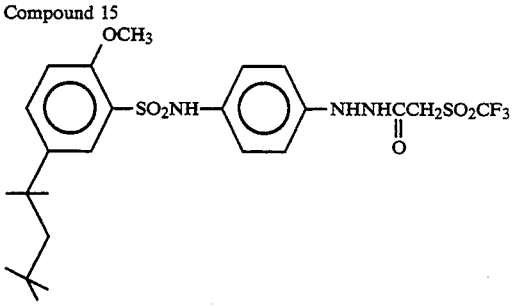
Compound 16
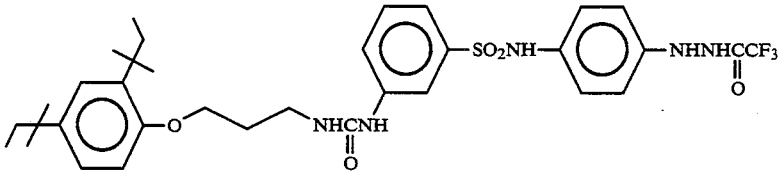
Compound 17
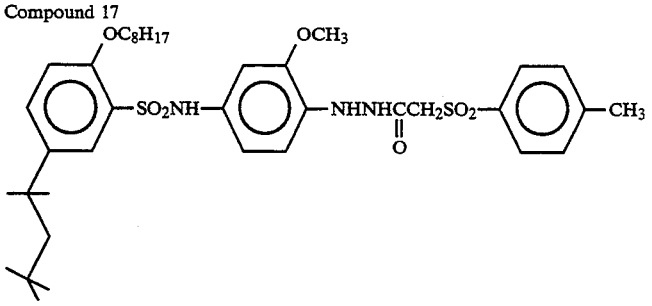
Compound 18
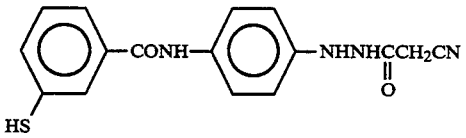

-continued
Compound 19
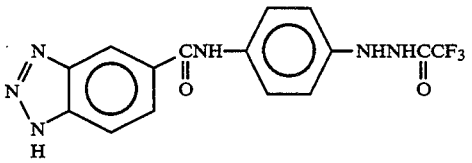
Compound 20
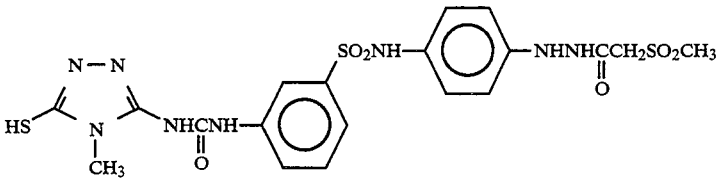
Compound 21
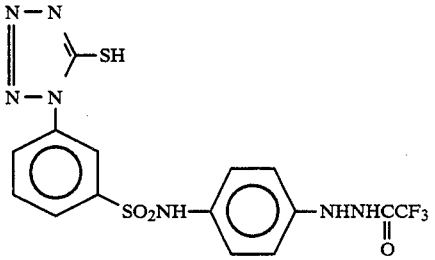
Compound 22
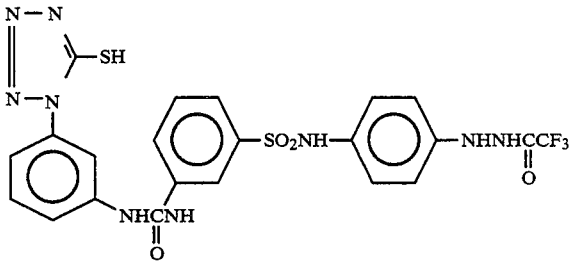
Compound 23
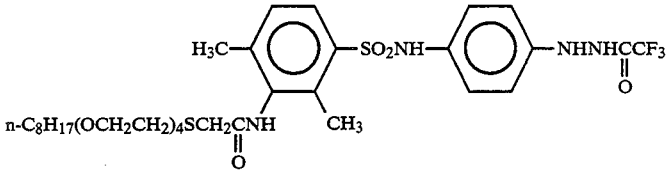
Compound 24
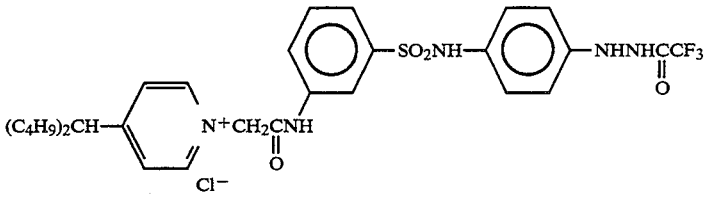
Compound 25
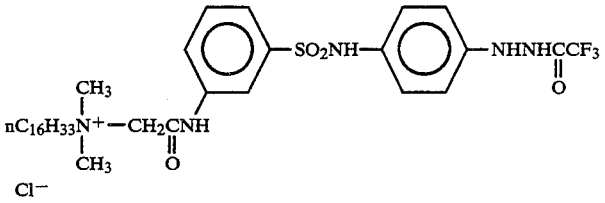

-continued
Compound 26
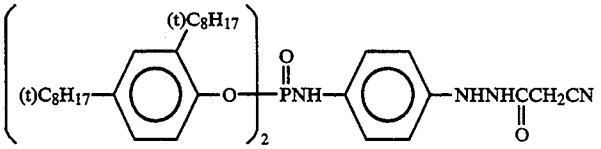
Compound 27
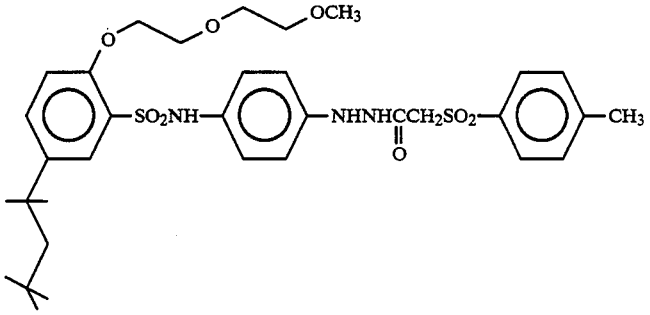
Compound 28
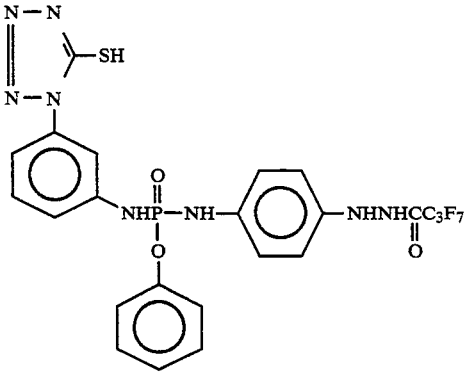
Compound 29
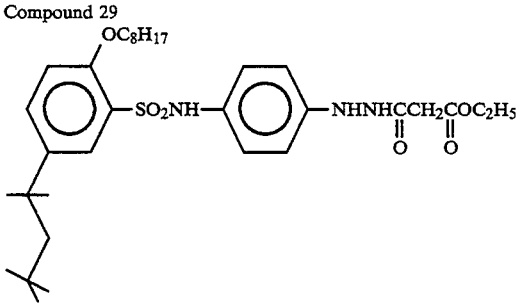
Compound 30
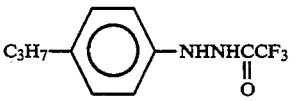
Compound 31
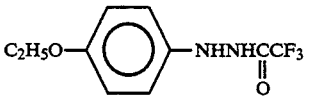
Compound 32
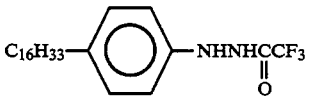

-continued
Compound 33
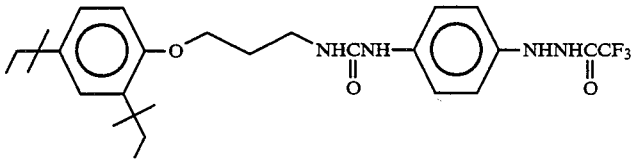
Compound 34
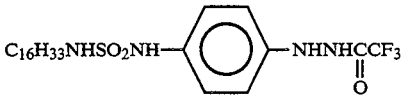
Compound 35
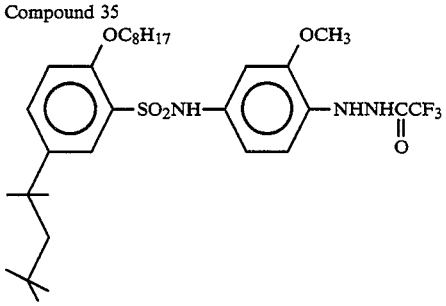
Compound 36
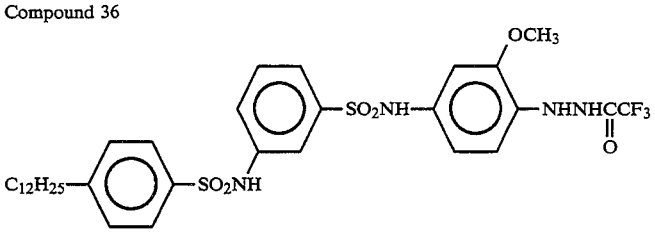
Compound 37
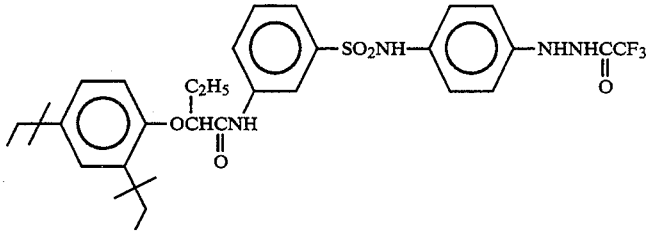
Compound 38
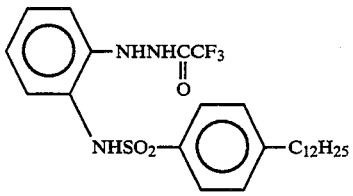
Compound 39
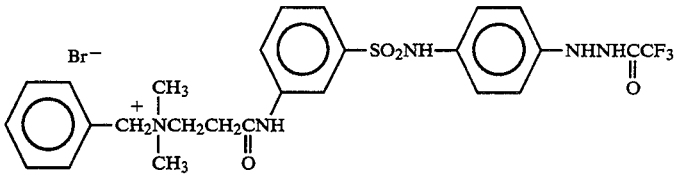
Compound 40

-continued

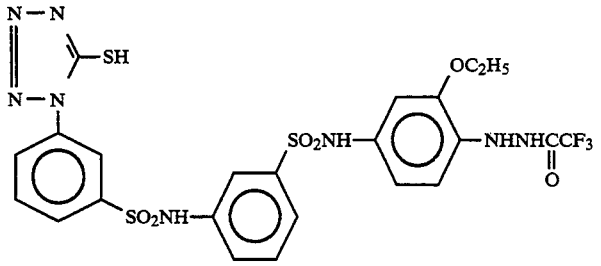

Compound 41

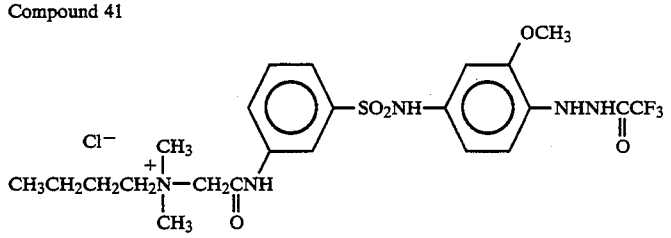

Compound 42

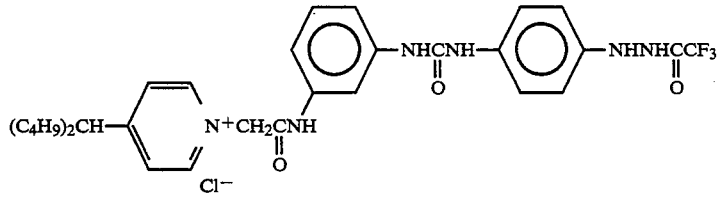

The hydrazine compounds of the present invention can be synthesized by reacting the corresponding hydrazine compound with the corresponding carboxylic acid in the presence of a condensing agent such as dicyclohexylcarbodiimide, or reacting the corresponding hydrazine compound with an acid halide such as sulfonylchloride and acylchloride, an acid anhydride or an active ester. Further, when the electron withdrawing group is $R_3SO_2-$ (wherein R represents an alkyl or aryl group), the compounds of the present invention can be synthesized by reacting the corresponding haloacetylhydrazide derivative with $R_3SO_2H$ in the presence of a base.

An embodiment of the preparation of the compound of the present invention is illustrated by means of the following synthesis example.

SYNTHESES EXAMPLE

Synthesis of Compound 16

Triethylamine (15.3 ml) was added to a mixed solution of Starting Compound A (63.2 g) and tetrahydrofuran (200 ml). The resulting mixed solution was cooled to 5° C., and trifluoroacetic acid anhydride (16.9 ml) was added thereto. The mixture was stirred overnight. The reaction mixture (solution) was poured into an aqueous solution of 1N HCl and extracted with ethyl acetate. The organic layer was washed with saturated sodium chloride aqueous solution and dried over anhydrous magnesium sulfate. Ethyl acetate was distilled off, and the product was isolated and purified by means of silica gel chromatography to obtain 52.1 g of the desired product. The structure of the product was confirmed by means of NMR and IR spectrums.

Starting Compound A had the following structure:

Starting Compound A

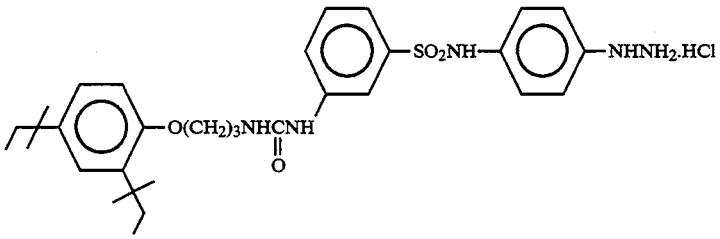

Synthesis methods for the compound of formula (1) are disclosed in U.S. Pat. Nos. 4,684,604, 4,988,604, and 4,994,365.

The compounds of formula (1) are used in an amount of preferably $1\times10^{-6}$ to $5\times10^{-2}$ mol, particularly preferably $1\times10^{-5}$ to $2\times10^{-2}$ mol, per mol of silver halide. When the amount exceeds $5\times10^{-2}$ mol per mol of silver halide in some extent, some of the compounds tend to precipitate, fogging tends to increase, in some cases contrast lowers, and when the compound has apsorption ability developability is restrained to thereby lower the sensitivity.

The compound of formula (1) may be added at least one of a silver halide emulsion layer and a light-insensitive hydrophilic colloid layer provided on the same side of the support as the side having a silver halide emulsion layer.

The compounds of formula (1) can be dissolved in an appropriate water-miscible organic solvent such as an alcohol (e.g., methanol, ethanol, propanol, fluorinated alcohol), a ketone (e.g., acetone, methyl ethyl ketone), dimethylformamide, dimethyl sulfoxide or methyl cellosolve, and the resulting solution may be used.

Further, the compounds can be mechanically emulsified and dispersed by conventional emulsifying dispersion methods using oils such as dibutyl phthalate, tricresyl phosphate, glyceryl triacetate or diethyl phthalate and a auxiliary solvent such as ethyl acetate or cyclohexanone, and the resulting emulsified dispersion may be used. Furthermore, redox compound powder may be dispersed in water in a ball mill or colloid mill or by means of ultrasonic wave by using a conventional solid dispersion method.

Silver halide emulsions which are used in the present invention comprise silver halide grains having such a halogen composition such that the silver chloride content thereof is not lower than 60 mol %, more preferably not lower than 70 mol % based on the total amount of silver halide. Silver halide which can be used in the present invention is any of silver chlorobromide, silver iodochloride and silver iodochlorobromide. The content of silver iodide is preferably not higher than 3 mol %, more preferably not higher than 0.5 mol %.

The silver halide emulsions of the present invention can be prepared by various methods conventionally used in the field of silver halide photographic materials. For example, the silver halide emulsions of the present invention can be prepared by the methods described in P. Glafkide, *Chemie et Physique Photographique* (Paul Montel 1967), G. F. Duffin, *Photographic Emulsion Chemistry* (The Focal Press 1966), and V. L. Zelikman at al., *Making and Coating Photographic Emulsion* (The Focal Press 1964).

The emulsions of the present invention are preferably monodisperse emulsions having a coefficient of variation of not higher than 20%, particularly preferably not higher than 15%.

The coefficient of variation is defined by the following formula (A):

$$\text{coefficient of variation (\%)} = \frac{\text{Standard deviation of grain size}}{\text{Mean grain size}} \times 100 \quad \text{(A)}$$

The silver halide grains contained in monodisperse silver halide emulsions preferably have a mean grain size of not larger than 0.5 μm, particularly preferably 0.1 to 0.4 μm.

A water-soluble silver salt (an aqueous solution of silver nitrate) may be reacted with a water-soluble halide by a single jet process, a double jet process or a combination thereof . There can be used a controlled double jet process wherein pAg in a liquid phase in which silver halide is formed is kept constant. It is preferred that grains are formed by using solvents for silver halide, such as ammonia, thioethers and tetrasubstituted thioureas.

Among them, the tetra-substituted thiourea compounds described in JP-A-53-82408 and JP-A-55-77738 are more preferred. Preferred thiourea compounds are tetramethylthiourea and 1 , 3-dimethyl-2-imidazolidinethione.

When the controlled double jet process or the grain-forming method using solvents for silver halide is used, silver halide emulsions comprising grains having a regular crystal form and a narrow grains size distribution can be easily prepared. Accordingly, the controlled double jet process and the grain-forming method using solvents for silver halide can be advantageously used to prepare the emulsions of the present invention.

It is preferred that the monodisperse emulsions comprise grains having a regular crystal form such as a cubic, octahedral or tetradecahedral form. A cubic form is particularly preferred.

With regard to the structure of the silver halide grain, the surface layer of the grain and the interior thereof may have a uniform phase or different phases.

In the preparation of the silver halide emulsions of the present invention, a cadmium salt, a sulfite, a lead salt, a thallium salt, a rhodium salt or a complex salt thereof, or an iridium salt or a complex salt thereof may be allowed to co-exist during the process of the formation of the silver halide grains or during the process of the physical ripening thereof.

It is preferred that the photographic material of the present invention contains a rhodium compound in order to obtain a high contrast and low fog formation.

In the present invention a water soluble rhodium compound may be used. Examples for such compounds include a rhodium (III) halogenide and a rhodium complex salt having a halogen, an amine or an oxalato as a ligand, such as a hexachlororhodate (III) complex salt, a hexabromorhodate complex salt, a hexaanminerhodate complex salt, and a trioxalatorhodate (III) complex salt. These rhodium compounds are used by dissolving them into water or into a suitable solvent. In order to obtain a stable solution of the rhodium compound conventional methods wherein an aqueous solution of a hydrohalogenic acid (e.g., hydrochloric acid, hydrobromic acid and hydrofluoric acid) or an alkali halide (e.g., KCl, NaCl, KBr and NaBr) is added to the solution containing the rhodium compound. In place of use a soluble rhodium compound, silver halide grains doped with a rhodium compound may be added and dissolved into a solution during preparation of silver halide.

The total amount of a rhodium compound is preferably $1\times10^{-8}$ to $5\times10^{-6}$, more preferably $5\times10^{-8}$ to $1\times10^{-6}$ mol per mol silver halide finally obtained in an emulsion.

The addition of rhodium compound may be conducted during silver halide formation, or upon any preparation step of an emulsion prior to coating of the emulsion. It is preferred that addition of the rhodium compound is conducted at the formation of an emulsion to thereby incorporate it into silver halide grains.

In the present invention, silver halide emulsions which are particularly suitable for use in the preparation of the light-sensitive materials for line working or halftone dot preparation are emulsions prepared by allowing $1\times10^{-8}$ to $1\times10^{-5}$ mol of an iridium salt or a complex salt thereof per mol of silver to coexist.

It is desirable that the above-described amount of an iridium salt is added before the completion of the physical ripening of the grains, particularly during the formation of the grains in the preparation of the silver halide emulsions.

The iridium salt which can be used herein is a water soluble salt or a water soluble complex salt thereof which can be used in the above stage include, iridium trichloride, iridium tetrachloride, potassium hexachloroiridate(III), potassium hexachloroiridate(IV) and ammonium hexachloroiridate(III).

The emulsion of the present invention can be chemically-sensitized by conventional sulfur sensitization, reduction sensitization, gold sensitization, etc. These sensitization methods may be used either alone or in combination. Preferred chemical sensitization methods are gold and sulfur sensitization methods.

Examples of sulfur sensitizing agents include sulfur compounds contained in gelatin and various sulfur compounds such as thiosulfates, thioureas, thiazoles and rhodanines. Specific examples thereof are described in U.S. Pat. Nos. 1,574,944, 2,278,947, 2,410,689, 2,728,668, 3,501,314 and 3,656,955. Preferred sulfur compounds are thiosulfates and thiourea compounds. During chemical sensitization, pAg is preferably not higher than 8.3, more preferably 7.3 to 8.0. The method using polyvinyl pyrrolidone and a thiosulfate in combination described in Moisar, *Klein Gelatin Proc. Syme. 2nd,* 301 to 309 (1976) gives favorable results.

One typical noble metal sensitization method is a gold sensitization method using gold compounds, particularly gold complex salts. Gold sensitizing agents may contain, in addition to gold, complex salts of other noble metals such as platinum, palladium, iridium, etc. Specific examples thereof are described in U.S. Pat. No. 2,448,060 and U.K. Patent 618,061.

Ultra-high-contrast and high-sensitivity photographic characteristics can be obtained by processing the silver halide light-sensitive materials of the present invention with stable developing solutions without using conventional infectious developing solutions or a high alkaline developing solution having a pH of nearly 13 described in U.S. Pat. No. 2,419,975.

Namely, a sufficiently ultra-high-contrast negative image can be obtained by processing the silver halide light-sensitive materials of the present invention with developing solutions preferably having a pH of 9.6 to 11.0 more preferably 10.0 to 10.8, and preferably containing a sulfite ion as a preservative, usually in an amount of at least 0.15 mol/l.

There is no particular limitation with regard to developing agents to be contained in the developing solutions of the present invention, but it is preferred from the viewpoint of easily obtaining halftone dots of good quality that the developing solutions contain dihydroxybenzenes. A combination of dihydroxybenzenes and 1-phenyl-3-pyrazolidone or a combination of dihydroxybenzenes and p-aminophenols may be used.

Examples of the dihydroxybenzene developing agents which can be used in the present invention include hydroquinone, chlorohydroquinone, bromohydroquinone, isopropylhydroquinone, methylhydroquinone, 2,3dichlorohydroquinone, 2,5-dichlorohydroquinone, 2,3-dibromohydroquinone and 2,5-dimethylhydroquinone. Among them, hydroquinone is particularly preferred.

Examples of the 1-phenyl-3-pyrazolidones which can be used as the developing agents in the present invention include 1-phenyl-3-pyrazolidone, 1-phenyl-4,4-dimethyl-4-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone and 1-p-tolyl-4,4-dimethyl-3-pyrazolidone.

Examples of the p-aminophenol developing agents which can be used in the present invention include N-methyl-p-aminophenol, p-aminophenol, N-(β-hydroxyethyl)-p-aminophenol, N-(4-hydroxyphenyl)glycine, 2-methyl-p-aminophenol and p-benzylaminophenol. Among them, N-methyl-p-aminophenol is preferred.

The developing agents are used in an amount of preferably 0.05 to 0.8 mol/l. When the dihydroxybenzenes are used in combination with the 1-phenyl-3-pyrazolidones or the p-aminophenols, the former is used in an amount of preferably 0.05 to 0.5 mol/l, and the latter is used in an amount of preferably not more than 0.06 mol/l.

Examples of the sulfites which can be used as preservatives in the present invention include sodium sulfite, potassium sulfite, lithium sulfite, ammonium sulfite, sodium bisulfite, potassium metabisulfite and formaldehyde sodium bisulfite adduct. The sulfites are used in an amount of preferably at least 0.15 mol/l, particularly preferably at least 0.3 mol/l. The upper limit is preferably 2.5 mol/l.

Examples of alkaline agents which are used to adjust pH include pH adjustors and buffering agents such as sodium hydroxide, potassium hydroxide, sodium carbonate, potassium carbonate, sodium tertiary phosphate and potassium tertiary phosphate. Acetic acid may also be used for adjecting the pH. The pH of the developing solutions is usually set to a value of 9.6 to 11.0.

Examples of additives which may be used in addition to the above-described ingredients include compounds such as boric acid and borax, restrainers such as sodium bromide, potassium bromide and potassium iodide; organic solvents such as a ethylene glycol, diethylene glycol, triethylene glycol, dimethylformamide, methyl cellosolve, hexylene glycol, ethanol and methanol; and anti-fogging agents or black pepper inhibitors such as 1-phenyl-5-mercaptotetrazole, indazole compounds (e.g., 5-nitroindazole) and benztriazole compounds (e.g., 5-methylbenztriazole). Further, the developing solutions may optionally contain a toning agent, a surfactant, an anti-foaming agent, a water softener, a hardening agent the amino compound described in JP-A-56-106244, and the amine compounds described in U.S. Pat. No. 4,269,929 as a development accelerator.

The developing solutions used in the present invention may contain the compounds, as silver stain inhibitors, described in JP-A-56-24347. Compounds described in JP-A-61-267759 can be used as dissolution aids to be added to the developing solutions. Further, the compounds described in JP-A-60--93433 or the compounds described in JP-A-62-186259 can be used as pH buffering agents in the developing solutions.

Conventional fixing agents can be used. Examples of suitable fixing agents include thiosulfates, thiocyanates and organosulfur compounds which are conventionally known as compounds having an effect as fixing agents. Fixing solutions may contain water-soluble aluminum salts (aluminum sulfate, alum) as hardening agents. The water-soluble aluminum salts are usually used in an amount of 0.4 to 2.0 g of Al per liter. Further, iron (III) compounds as oxidizing agents can be used in the form of complex salts with ethylenediaminetetraacetic acid.

The development processing temperature is usually 18 ° to 50° C., preferably 25 ° to 43° C.

Additives described in the following patent specifications can be preferably applied to the light-sensitive materials of the present invention without particular limitation. Places where the additives are described are listed below.

| Additive | Patent specification |
|---|---|
| (1) Nucleating accelerator | Preferably in an amount of from $1 \times 10^{-5}$ to $5 \times 10^{-2}$ mol/Ag mol. Compounds disclosed in U.S. Pat. Nos. 4,851,321, 4,863,830, 4,929,535, 4,619,886, and 5,196,291. |
| (2) Spectral sensitizing dyes | JP-A-2-12236 (the 13th line of left lower column to the 4th line of right lower column of page 8); JP-A-2-103536 (the third line of right lower column of page 16 to the 20th line of left lower column of page 17); and spectral sensitizing dyes described in JP-A-1-112235, JP-A-2-124560, and JP-A-3-7928. |
| (3) Surfactant | JP-A-12236 (the 7th line of right upper column to the 7th line of right lower column of page 9); and JP-A-2-18542 (the 13th line of left lower column of page 2 to the 18th line of right lower column of page 4) |
| (4) Anti-fogging agent | JP-A-2-103536 (the 19th line of right lower column of page 17 to the 4th line of right upper column of page 18, and the first line to the 5th line of right lower column of page 18); and thiosulfinic acid compounds described in JP-A-1-237538 |
| (5) Polymer latex | JP-A-2-103536 (the 12th line to the 20th line of left lower column of page 18) |
| (6) Compounds having an acid group | JP-A-2-103536 (the 6th line of right lower column of page 18 to the first line of left upper column of page 19) |
| (7) Matting agent, lubricant, plasticizer | JP-A-2-103536 (the 15th line of left upper column of page 19 to the 15th line of right upper column of page 19) |
| (8) Hardening agent | JP-A-2-103536 (the 5th line to the 17th line of right upper column of page 18) |
| (9) Dye | Dyes described in JP-A-2-103536 (the first line to the 18th line of right lower column of page 17); and solid dyes described in JP-A-2-294638 and Japanese Patent Application No. 3-185773 |
| (10) Binder | JP-A-2-18542 (the first line to the 20th line of right lower column of page 3) |
| (11) Black pepper inhibitor | Compounds described in U.S. Pat. No. 4,956,257 and JP-A-1-118832 |
| (12) Redox compound | Compounds of formula (I) (particularly compounds 1 to 50) described in JP-A-2-301743; compounds of formulas (R-1), (R-2), (R-3), compounds 1 to 75 described in JP-A-3-174143 (pp. 3-20); and compounds described in Japanese Patent Application Nos. 3-69466 and 3-15648 |
| (13) Monomethine | Compounds of formula (II) (particularly compounds II-1 to II-26) described JP-A-2-287532 |
| (14) Dihydroxy-benzenes | JP-A-3-39948 (left lower column of page 11 to left lower column of page 12); and compounds described in EP 452,772A |

The present invention is now illustrated in greater detail by reference to the following examples which, however, are not to be construed as limiting the present invention in any way.

EXAMPLE 1

Preparation of Emulsion of Invention

Emulsion A

An aqueous solution of 0.13M silver nitrate and an aqueous halide solution containing $1 \times 10^{-7}$ mol (per mol of silver) of $(NH_4)_3RhCl_6$, 0.04 M potassium bromide and 0.09 M sodium chloride were added to an aqueous gelatin solution containing sodium chloride and 1,3-dimethyl-2-imidazolidinethione with stirring at 38° C. over a period of 12 minutes by means of a double jet process to obtain silver chlorobromide grains having a mean grain size of 0.15 μm and a silver chloride content of 70 mol %, whereby nucleation was effected. Subsequently, an aqueous solution of 0.87 M silver nitrate and an aqueous halide solution containing 0.26 M potassium bromide and 0.65 M sodium chloride were added thereto over a period of 20 minutes by means of a double jet process.

Subsequently, $1 \times 10^{-3}$ mol of KI solution was added thereto and conversion was made. The resulting emulsion was washed with water by a conventional flocculation method, and 40 g of gelatin was added thereto. The pH of the emulsion was adjusted to 6.5, and the pAg thereof was adjusted to 7.5. Further, 5 mg of sodium thiosulfate and 8 mg of chloroauric acid were added thereto, each amount being per mol of silver. The emulsion was heated at 60° C. for 60 minutes to conduct chemical sensitization, and 150 mg of 4-hydroxy-6-methyl-l,3,3a,7-tetrazaindene as a stabilizer was added thereto. The resulting grains were silver chlorobromide cubic grains having a mean grain size of 0.27 μm and a silver chloride content of 70 mol % (a coefficient of variation: 10%).

Preparation of Comparative Emulsion B

A cubic monodisperse silver iodobromide emulsion having a grain size of 0.25 μm (a coefficient of variation: 0.15%, silver iodide content: 1.0 mol %, iodide distribution being uniform) was prepared by means of a controlled double jet process. To the silver iodobromide emulsion, was added $K_3IrCl_6$ in such an amount as to give $4 \times 10^{-7}$ tool per tool of Ag.

The emulsion was desalted by a flocculation method and kept at 50° C. To the emulsion, there are added $10^{-3}$ mol (per mol of silver) of potassium iodide solution and $5 \times 10^{-4}$ mol (per mol of silver) of 4-hydroxy6-methyl-l,3,3a,7-tetrazaindene as a stabilizer.

Preparation of Coated Sample

The hydrazine derivatives indicated in Table 1 were added to these emulsions. The following compounds were used as comparative compounds for the purpose of comparison with the hydrazine derivatives of the present invention.

Comparative Compound A

-continued

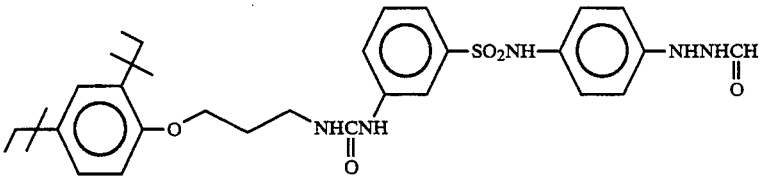

Comparative Compound B

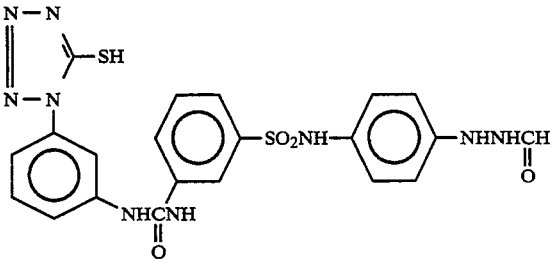

Comparative Compound C

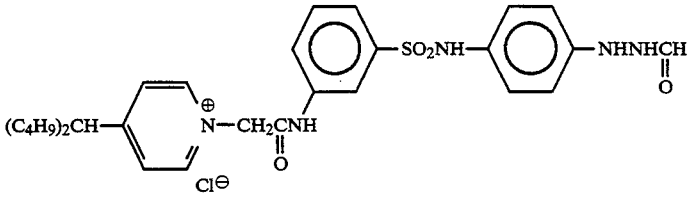

TABLE 1

| Sample No. | Emulsion | Hydrazine derivative: Compound No. | Hydrazine derivative: Amount added* (mol/Ag mol) |
|---|---|---|---|
| Comparative Example | | | |
| 1 | Emulsion B | Compound 16 | $2.5 \times 10^{-3}$ |
| 2 | Emulsion B | Compound 22 | $3.0 \times 10^{-4}$ |
| 3 | Emulsion A | Comparative compound A | $2.5 \times 10^{-3}$ |
| 4 | Emulsion A | Comparative compound B | $3.0 \times 10^{-4}$ |
| 5 | Emulsion A | Comparative compound C | $6.0 \times 10^{-4}$ |
| Invention | | | |
| 6 | Emulsion A | Compound 16 | $1.3 \times 10^{-3}$ |
| 7 | Emulsion A | Compound 22 | $1.5 \times 10^{-4}$ |
| 8 | Emulsion A | Compound 24 | $3.0 \times 10^{-4}$ |

*Each amount was selected to obtain best photographic characteristics.

Further, $3.4\times10^{-4}$ mol (per mol of silver) of the following compound having the following structural formula (S), $2\times10^{-4}$ mol (per mol of silver) of 1-phenyl-5-mercaptotetrazole, $5\times10^{-4}$ mol (per mol of silver) of a short wave region cyanine dye having the following structural formula (a), the following water-soluble latex (b) (solid:200 mg/m$^2$), a polyethyl acrylate dispersion (solid:200 mg/m$^2$), and 1,3-divinylsulfonyl-2-propanol (200 mg/m$^2$) as a hardening agent were added.

(S)

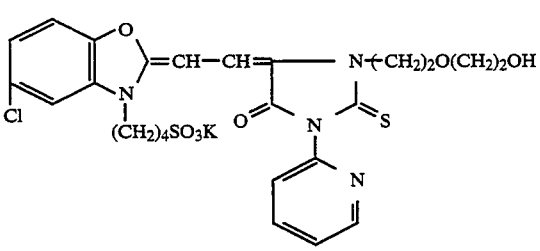

(a)

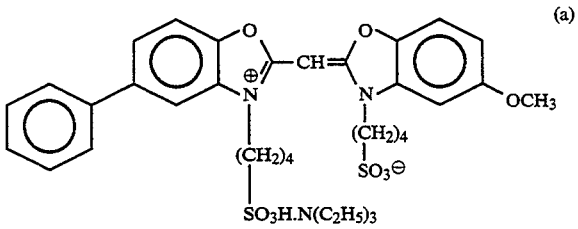

(b)

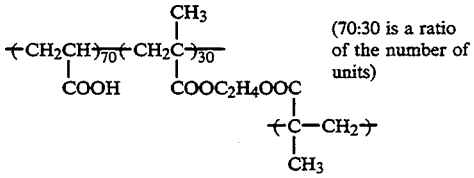

(70:30 is a ratio of the number of units)

The following amine compound (20 mg/m$^2$) as a nucleating accelerator was added.

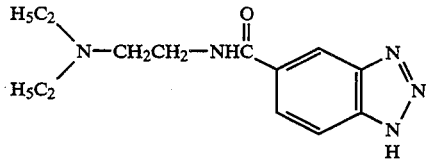

A layer comprising gelatin (1.0 g/m$^2$), amorphous $SiO_2$ matting agent having a particle size of about 3.5 μm (40 mg/m$^2$), methanol silica (0.1 g/m$^2$), polyacrylamide (100 mg/m$^2$), hydroquinone (200 mg/m$^2$), silicon oil and the following fluorine-containing surfactant and sodium dodecylbenzenesulfonate as coating aids as a protective layer and the emulsion layer were simultaneously coated.

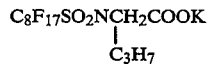

Further, a back layer having the following formulation and a protective layer having the following formulation for the back layer were coated.

| Back layer | |
|---|---|
| Gelatin | 3 g/m$^2$ |
| Latex of polyethyl acrylate | 2 g/m$^2$ (solid content) |
| Surfactant (sodium p-dodecylbenzenesulfonate) | 40 mg/m$^2$ |
| Hardening agent for gelatin | 110 mg/m$^2$ |

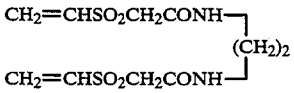

| | |
|---|---|
| Fluorine-containing surfactant | 5 mg/m$^2$ |

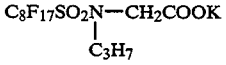

| | |
|---|---|
| Dye: a mixture of the following Dyes (a), (b) and (c) | |
| Dye (a) | 50 mg/m$^2$ |

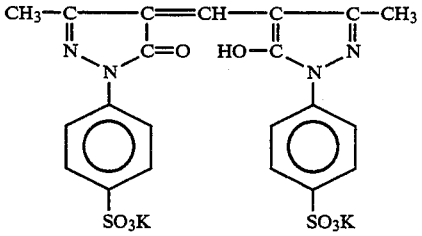

| | |
|---|---|
| Dye (b) | 100 mg/m$^2$ |

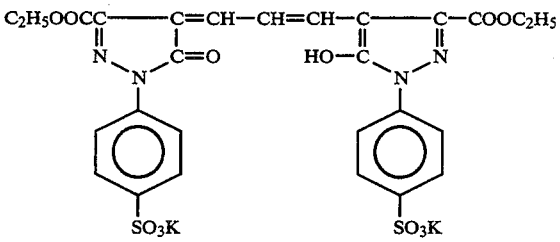

| | |
|---|---|
| Dye (c) | 50 mg/m$^2$ |

-continued

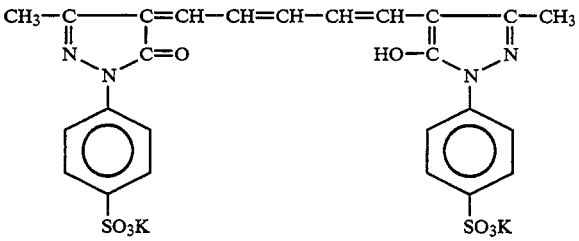

| Protective layer for back layer | |
|---|---|
| Gelatin | 0.8 mg/m$^2$ |
| Fine particles of polymethyl methacrylate (average particle size: 4.5 μm) | 30 mg/m$^2$ |
| Sodium dihexyl α-sulfosuccinate | 15 mg/m$^2$ |
| Sodium dodecylbenzenesulfonate | 15 mg/m$^2$ |
| Sodium acetate | 4 mg/m$^2$ |

Evaluation of photographic characteristics

These samples were exposed to tungsten light (3200° K.) through an optical wedge or through an optical wedge and a contact screen (150 L chain dot type manufactured by Fuji Photo Film Co., Ltd.), developed with the following developing solution 1 at 38° C. for 30 seconds, fixed, rinsed with water and dried.

The fixing solution used was GR-Fl manufactured by Fuji Photo Film Co., Ltd.

| Developing Solution (1) | Amount (g) |
|---|---|
| Hydroquinone | 30.0 |
| N-Methyl-p-aminophenol | 0.3 |
| Sodium hydroxide | 10.0 |
| Potassium sulfite | 60.0 |
| Disodium ethylenediaminetetraacetate | 1.0 |
| Potassium bromide | 10.0 |
| 5-Methylbenztriazole | 0.4 |
| 2-Mercaptobenzimidazole-5-sulfonic acid | 0.3 |
| Sodium 3-(5-mercaptotetrazole)-benzenesulfonate | 0.2 |
| Sodium toluenesulfonate | 8.0 |
| Adjusting of pH and addition of water was conducted to obtain 1 l of developer having a pH of 10.6 | |

Further, development processing was carried out by using Developing Solution (2) (obtained by adjusting the pH of Developing Solution (1) with a potassium hydroxide solution to 10.8) and Developing Solution (3) (obtained by adjusting the pH of Developing Solution (1) with acetic acid to 10.4).

The resulting photographic characteristics are shown in Table 2. G (gamma) in Table 2is defined by the following formula (2).

$$G = \frac{3.0 - 0.3}{\log(\text{exposure amount giving a density of } 3.0) - \log(\text{exposure amount giving a density } 0.3)} \quad (2)$$

$S_{1.5}$ which represents sensitivity is the logarithm value of an exposure amount giving a density of 1.5.

It can be seen from Table 2 that even when the samples of the present invention are processed with the developing solutions having a pH lower than 11, high-contrast image can be obtained, and a change in photographic sensitivity caused by fluctuation of the pH of the developing solution is small.

TABLE 2

| Sample No. | G (Developing Solution (1)) | Dependence of $S_{1.5}$ on pH of developing solution | |
|---|---|---|---|
| | | $\Delta S_{pH+0.2}$* | $\Delta S_{pH-0.2}$* |
| Comparative Example | | | |
| 1 | 4.1 | 0.02 | −0.01 |
| 2 | 4.2 | 0.01 | −0.01 |
| 3 | 7.3 | 0.16 | −0.18 |
| 4 | 8.2 | 0.17 | −0.17 |
| 5 | 15.2 | 0.15 | −0.14 |
| Invention | | | |
| 6 | 12.8 | 0.06 | −0.06 |
| 7 | 13.5 | 0.07 | −0.07 |
| 8 | 16.7 | 0.08 | −0.07 |

*$\Delta S_{pH+0.2}$ = ($S_{1.5}$ obtained by Developing Solution (2)) − ($S_{1.5}$ obtained by Developing Solution (1))
*$\Delta S_{pH-0.2}$ = ($S_{1.5}$ obtained by Developing Solution (3)) − ($S_{1.5}$ obtained by Developing Solution (1))

EXAMPLE 2

The procedure of Example 1 was repeated, except that the coated samples indicated in Table 1 were processed with the following Developing Solution (4).

| Developing Solution (4) | Amount (g) |
|---|---|
| Hydroquinone | 30.0 |
| N-Methyl-p-aminophenol | 0.3 |
| Sodium hydroxide | 10.0 |
| Potassium sulfite | 60.0 |
| Disodium ethylenediaminetetraacetate | 1.0 |
| Potassium bromide | 10.0 |
| 5-Methylbenztriazole | 0.4 |
| 5-Mercaptobenzimidazole-5-sulfonic acid | 0.3 |
| Sodium 3-(5-mercaptotetrazole)-benzenesulfonate | 0.2 |
| Sodium toluenesulfonate | 8.0 |
| N-Dimethyl-n-hexanolamine | 5.0 |
| Adjusting of pH and addition of water was conducted to obtain 1 l of developer having a pH of 10.2. | |

The resulting photographic characteristics are shown in Table 3.

TABLE 3

| Sample No. | G (Developing Solution (4)) | Dependence of $S_{1.5}$ on pH of developing solution | |
|---|---|---|---|
| | | $\Delta S_{pH+0.2}$* | $\Delta S_{pH-0.2}$* |
| Comparative Example | | | |
| 1 | 4.9 | 0.01 | −0.01 |
| 2 | 4.8 | 0.01 | −0.01 |
| 3 | 7.7 | 0.18 | −0.20 |
| 4 | 8.5 | 0.19 | −0.19 |
| 5 | 14.9 | 0.16 | −0.16 |
| Invention | | | |
| 6 | 12.2 | 0.07 | −0.08 |
| 7 | 13.1 | 0.08 | −0.09 |
| 8 | 15.9 | 0.08 | −0.09 |

*$\Delta S_{pH+0.2}$ = ($S_{1.5}$ obtained by Developing Solution (1)) − ($S_{1.5}$ obtained by Developing Solution (3))
*$\Delta S_{pH-0.2}$ = ($S_{1.5}$ obtained by Developing Solution (4)) − ($S_{1.5}$ obtained by Developing Solution (3))

It can be seen from Table 3 that the effect of the present invention can be obtained even when the pH of the developing solution is lowered to 10.2, by adding an amine compound to the developing solution.

It will be understood from the above disclosure that according to the present invention there can be provided a silver halide photographic material which enables an ultra-high-contrast negative image to be obtained even when using a stable developing solution.

While the present invention has been described in detail and with reference to specific embodiments thereof, it is apparent to one skilled in the art that various changes and modifications can be made therein without departing from the spirit and the scope of the present invention.

What is claimed is:

1. A photographic image forming method wherein a silver halide photographic material is processed with a developing solution having a pH of 9.6 to 11.0, said silver halide photographic material having at least one light-sensitive layer containing a chemically-sensitized silver halide emulsion comprising silver halide grains having a silver chloride content of at least 60 mol %, wherein at least one of said at least one light-sensitive layer and a light-insensitive hydrophilic colloid layer contains a hydrazine compound represented by the formula (1):

$$R^1—NHNH—G—R^2 \quad (1)$$

wherein $R^1$ represents a substituted aliphatic group, aromatic group or heterocyclic group; G represents —CO—, —$SO_2$—, —SO—, —COCO—, a thiocarbonyl group, an iminomethylene group or —P(O) ($R^4$)—; $R^2$ represents a substituted alkyl group in which at least one electron withdrawing group is bonded to the carbon atom of $R^2$ which carbon atom is attached to G; and $R^4$ represents a hydrogen atom, a substituted or unsubstituted aliphatic group, an aromatic group, an alkoxy group, an aryloxy group or an amino group; the substituent for $R^1$ is a group represented by formula (c):

$$R_{c1}—L—Y_c—\underset{\underset{R_{c2}}{|}}{N}— \quad (c)$$

wherein $Y_c$ represents —CO—, —$SO_2$—, —P(O) ($R_{c3}$)— or —OP(O) ($R_{c3}$)— (wherein $R_{c3}$ is an alkoxy group or an aryloxy group); L represents a single bond, —O—, —S— or —$NR_{c4}$— (wherein $R_{c4}$ is a hydrogen atom, a substituted or unsubstituted aliphatic, alicyclic or aromatic group), $R_{c1}$ represents an aromatic group or heterocyclic group substituted with a group selected from the group consisting of an aralkyl group, an alkenyl group, an alkynyl group, an alkoxy group, a substituted amino group, an acylamino group, an alkyl- or aryl-sulfonlyamino, a ureido group, ROCONH— (wherein R represents an alkyl or aryl group), an aryloxy group, a sulfamoyl group, a carbamoyl group, an alkylthio group, an arylthio group, an alkyl- or aryl-sulfonyl group, an alkyl- or aryl-sulfinyl group, a hydroxy group, a halogen atom, a cyano group, —COOM, —$SO_3$M (wherein M represents a hydrogen atom, an alkali metal atom, —$NH_4$ or an ammonio group), an alkyl- or aryl-oxycarbonyl group, an acyl group, an acyloxy group, a carbonamido group, a sulfonamido group, a nitro group, an alkylthio group, and an arylthio group; $R_{c2}$ represents a hydrogen atom, a substituted or unsubstituted aliphatic group, alicycylic group, aromatic group, or heterocyclic group.

2. The photographic image forming method as in claim 1, wherein $R_{c1}$ is an aromatic group.

3. The photographic image forming method as in claim 1, wherein $R^1$ is further substituted by a substituent selected from the group consisting of an alkyl group, an aralkyl group, an alkenyl group, an alkynyl group, an alkoxy group, an aryl group, a substituted amino group, an aryloxy group, a sulfamoyl group, a carbamoyl group, an alkylthio group, an arylthio group, an alkyl- or aryl-sulfonyl group, an alkyl- or aryl-sulfinyl group a hydroxyl group, a halogen atom, a cyano group, —$SO_3M$ and —COOM (wherein M represents a hydrogen atom, an alkali metal atom, —$NH_4$ and an ammonio group), an alkyl- or aryl-oxycarbonyl group, an acyl group, an acyloxy group, a carbonamido group, a sulfonamido group, a nitro group, an alkylthio group, and an arylthio group.

4. The photographic image forming method as in claim 1, wherein the substituent for $R_{c2}$ and $R_{c4}$ is selected from the group consisting of an alkyl group, an aralkyl group, an alkenyl group, an alkynyl group, an alkoxy group, an aryl group, a substituted amino group, an acylamino group, an alkyl- and aryl-sulfonylamino group, a ureido group, ROCONH— (wherein R represents an alkyl or aryl group), an aryloxy group, a sulfamoyl group, a carbamoyl group, an alkylthio group, an arylthio group, an alkyl- and aryl-sulfonyl group, an alkyl- and aryl-sulfinyl group, a hydroxy group, a halogen, a cyano group, —COOM and —$SO_3M$ (wherein M represents a hydrogen atom, an alkali metal atom, —$NH_4$ and an ammonio group), an alkyl- or aryl-oxycarbonyl group, an acyl group, an acyloxy group, a carbonamido group, a sulfonamido group, a nitro group, an alkylthio group an arylthio group, an ammonio group, and a mercapto group.

5. The photographic image forming method as in claim 1, wherein $Y_c$ is —$SO_2$—.

6. The photographic image forming method as in claim 1, wherein L is a single bond.

7. The photographic image forming method as in claim 1, wherein $R_{c2}$ is a hydrogen atom.

8. The photographic image forming method as in claim 1, wherein $R_1$ is an aryl group.

9. The photographic image forming method as in claim 1, wherein G is —CO—.

10. The photographic image forming method as in claim 1, wherein said electron withdrawing group has an $\sigma_p$ value of at least 0.2 or a $\sigma$m value of at least 0.3.

11. The photographic image forming method as in claim 1, wherein the alkyl group represented by $R^2$ has two electron withdrawing groups.

12. The photographic image forming method as in claim 1, wherein the alkyl group represented by $R^2$ has three electron withdrawing groups.

13. The photographic image forming method as in claim 1, wherein the total value of $\sigma_p$ or $\sigma_m$ of the electron withdrawing groups is not more than 2.0.

14. The photographic image forming method as in claim 1, wherein said electron withdrawing group is a group selected from the group consisting of a halogen, cyano group, nitro group, a nitrosopolyhaloalkyl group, a polyhaloaryl group, an alkyl- or aryl-oxycarbonyl group, a formyl group, an alkyl- or aryl-oxycarbonyl group, an alkylcarbonyloxy group, a carbamoyl group, an alkyl- or arylsulfinyl group, an alkyl- or aryl-sulfonyl group, an alkyl- or aryl-sulfonyloxy group, a sulfamoyl group, a phosphino group, a phosphine oxide group, a phosphonic ester group, a phosphonic acid amido group, an arylazo group, an amidino group, an ammonio group, a sulfonio group and a nitrogen-containing heterocyclic group.

15. The photographic image forming method as in claim 1, wherein $R^2$ is a trifluoromethyl group.

16. The photographic image forming method as in claim 1, wherein the amount of the compound represented by formula (1) is from $1\times10^{-6}$ to $5\times10^{-2}$ mol per mol of silver halide.

17. The photographic image forming method as in claim 1, wherein the silver halide emulsion contains a rhodium compound in an amount of from $1\times10^{-8}$ to $5\times10^{-6}$ mol per mol of silver halide.

18. The photographic image forming method as in claim 1, wherein the silver halide emulsion is sensitized by a gold-sulfur sensitization.

* * * * *